US010246870B1

(12) United States Patent
Busby

(10) Patent No.: US 10,246,870 B1
(45) Date of Patent: Apr. 2, 2019

(54) CONSTRUCTION VENTING STRIP

(71) Applicant: Philip J Busby, Sioux Falls, SD (US)

(72) Inventor: Philip J Busby, Sioux Falls, SD (US)

( * ) Notice: Subject to any disclaimer, the term of this patent is extended or adjusted under 35 U.S.C. 154(b) by 0 days.

(21) Appl. No.: 15/711,739

(22) Filed: Sep. 21, 2017

(51) Int. Cl.

| | |
|---|---|
| ***E04B 1/66*** | (2006.01) |
| ***E04D 13/15*** | (2006.01) |
| ***E04B 9/02*** | (2006.01) |
| ***E04D 13/152*** | (2006.01) |
| *E04D 5/12* | (2006.01) |

(52) U.S. Cl.
CPC ..... *E04B 1/665* (2013.01); *E04B 9/02* (2013.01); *E04D 13/152* (2013.01); *E04D 5/12* (2013.01)

(58) Field of Classification Search
CPC ..... E04B 1/665; E04B 9/02; E04D 13/152; E04D 5/12
See application file for complete search history.

(56) References Cited

U.S. PATENT DOCUMENTS 4,567,816 A * 2/1986 Kolt ..... F24F 13/1426 137/512.15
4,857,407 A * 8/1989 Coleman ..... B32B 17/10018 428/412
4,937,990 A * 7/1990 Paquette ..... E04D 11/02 52/199
5,069,950 A * 12/1991 Crookston, Sr. ..... E04D 13/172 428/156
5,369,926 A * 12/1994 Borland ..... E04D 11/02 428/158
5,402,931 A * 4/1995 Gulliver ..... B65D 5/2004 229/120.17
5,473,847 A * 12/1995 Crookston ..... E04C 2/205 454/260
5,549,345 A * 8/1996 Cawthon ..... B60H 1/3407 296/208
5,867,956 A * 2/1999 Gregory, Jr. ..... E04D 13/172 428/167
6,079,166 A * 6/2000 Mason ..... E04D 13/174 454/365
6,718,699 B1 * 4/2004 Larson ..... E04D 13/178 52/371
7,484,335 B1 * 2/2009 Dunlap ..... E04D 13/152 52/302.3
7,887,900 B2 * 2/2011 DiPede ..... B32B 3/085 427/280

(Continued)

FOREIGN PATENT DOCUMENTS

CA 2969573 A1 * 12/2017 ..... E04B 1/625
JP 2002150353 A * 5/2002

*Primary Examiner* — Jeanette E Chapman
(74) *Attorney, Agent, or Firm* — Mark S Hubert

(57) ABSTRACT

A construction venting strip to be placed at the interfaces between framing members that enclose a space. The strip acts as a conduit for the passage of air across it; prevents water from pooling on the surface of underlying framing members; seals penetrations passing through the strip and into the underlying framing members; acts as a thermal break; and may be used as a furring or shim strip. It is a linear strip of polymer with a side locating flange and a waterproof, self-sealing strip in its bottom face, The top face of the strip base has spaced pads extending therefrom with air passage channels there between. The air passage channels are configured for angular cut lines.

10 Claims, 6 Drawing Sheets

(56) References Cited

U.S. PATENT DOCUMENTS 7,987,649 B1 * 8/2011 Polston ..... E04D 13/152 454/260
8,302,352 B2 * 11/2012 Bahn ..... E04D 13/174 52/199
8,381,458 B2 * 2/2013 Rider, Jr. ..... E04D 13/178 52/302.3
8,561,359 B2 * 10/2013 Rosten ..... E04D 13/152 52/199
9,091,049 B2 * 7/2015 Walker ..... E04B 7/20
9,592,529 B2 * 3/2017 Xiangli ..... E04B 1/62
9,976,299 B2 * 5/2018 Power ..... E04B 1/70
2005/0126088 A1 * 6/2005 Rotter ..... E04D 1/36 52/198
2006/0211366 A1 * 9/2006 Villela ..... F24F 7/02 454/365
2006/0230707 A1 * 10/2006 Roe ..... E04D 13/172 52/794.1
2007/0039252 A1 * 2/2007 Railkar ..... E04D 13/002 52/44
2007/0093197 A1 * 4/2007 Shah ..... F24F 13/082 454/365
2007/0234650 A1 * 10/2007 Coulton ..... E04D 13/152 52/95
2008/0220714 A1 * 9/2008 Caruso ..... E04D 13/152 454/365
2008/0287054 A1 * 11/2008 Carlson ..... E04D 13/174 454/365
2010/0139178 A1 * 6/2010 Ehrman ..... B32B 5/08 52/58
2013/0180203 A1 * 7/2013 Xiangli ..... E04B 1/62 52/741.3
2013/0276392 A1 * 10/2013 Johnson ..... E04F 13/04 52/302.1
2014/0134408 A1 * 5/2014 Milne ..... E04B 1/665 428/195.1
2017/0276388 A1 * 9/2017 Rotter ..... E04D 13/174
2018/0100303 A1 * 4/2018 Dahlin ..... E04B 2/04

* cited by examiner

FIG 1
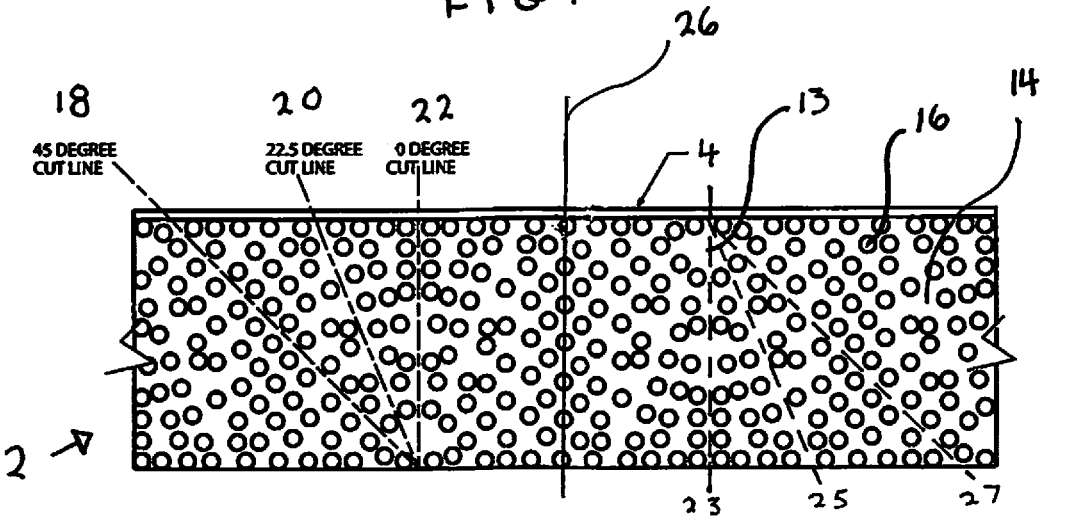
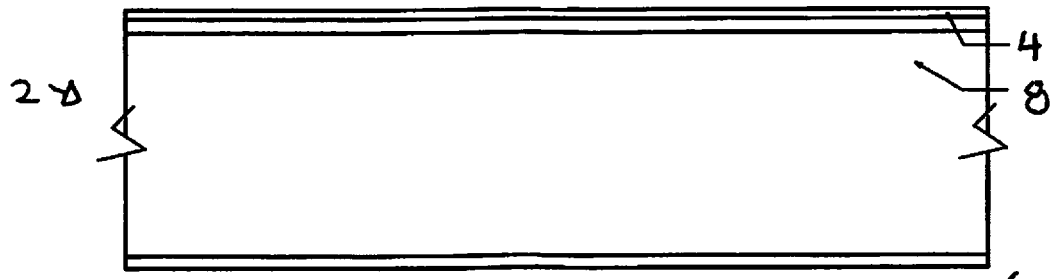
FIG 2
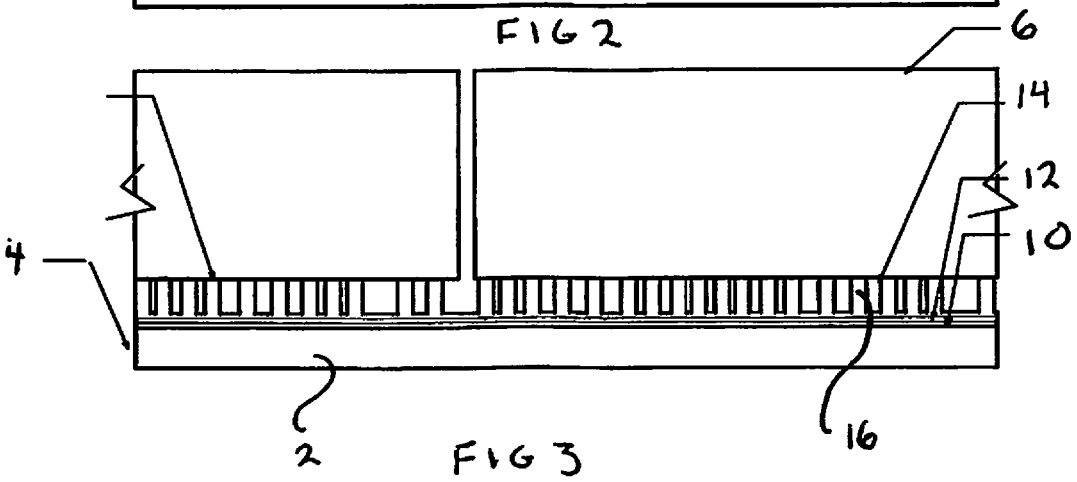
FIG 3

FIG 7
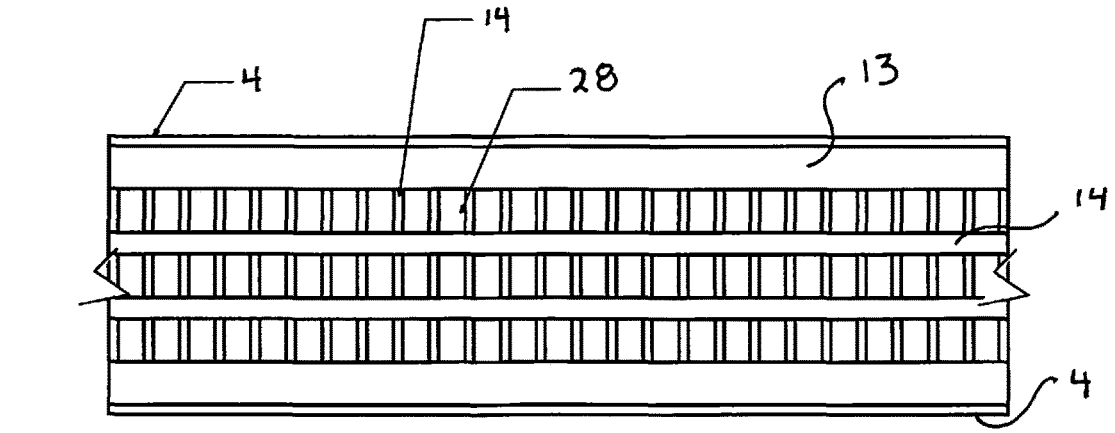
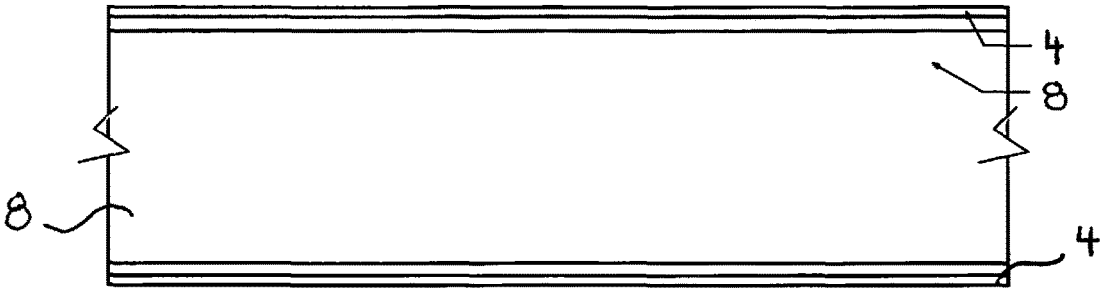
FIG 8
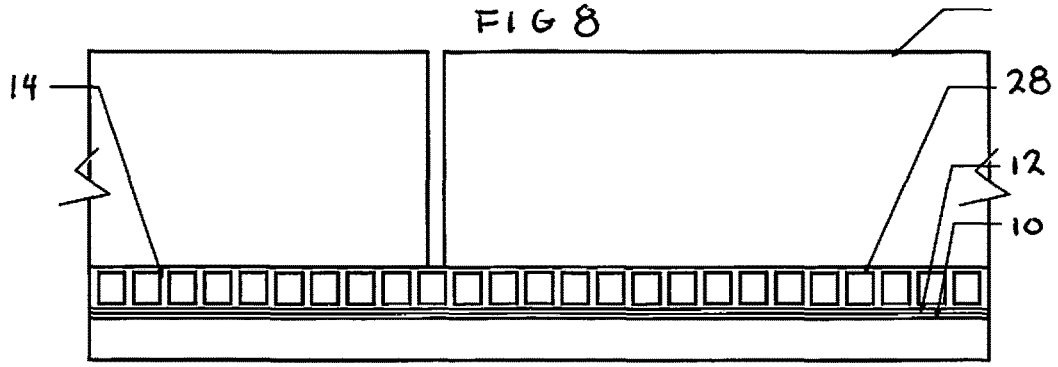
FIG 9

FIG 13
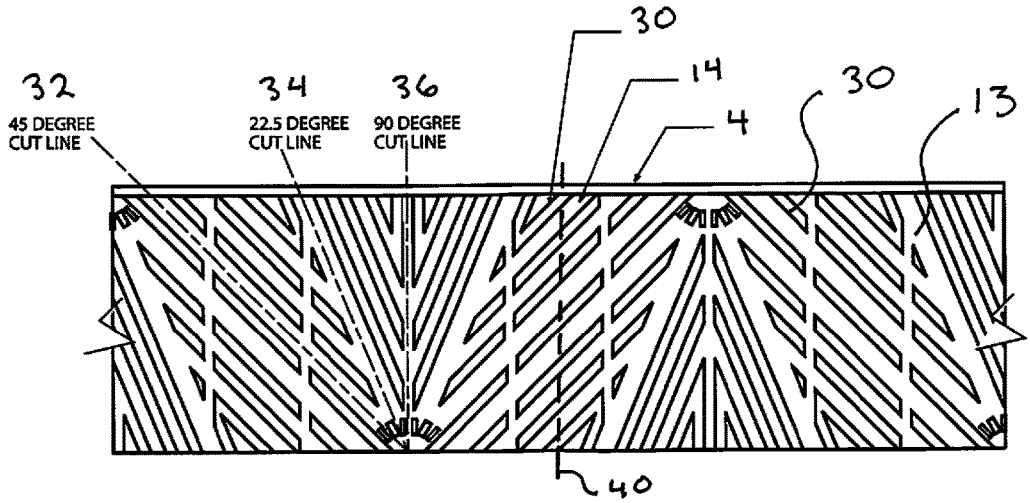
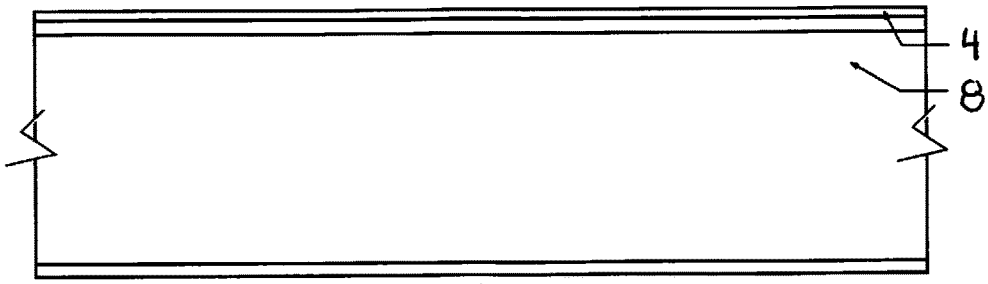
FIG 14
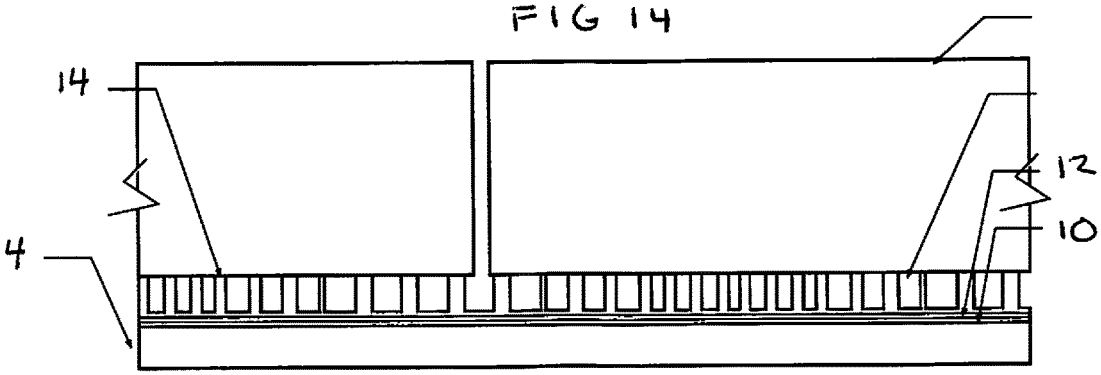
FIG 15

CONSTRUCTION VENTING STRIP

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The present disclosure relates, in general, to construction materials, and more particularly to moisture avoidance and venting technology for use with conventional building framing methodology.

BACKGROUND

Trapped moisture between construction materials in buildings causes a plethora of different damages from mildew/mold development, wood rot, surface staining, loss of insulating capability and freeze expansion damage. Some of these damages occur in the short term, can be noticed and rectified, while others take time to manifest and cannot be rectified, rather require rebuilding.

Air that is trapped in hollow cavities or that has very slow migration, often infiltrates these cavities as warm, moist air. As the temperatures drop and the surrounding materials cool, the dew point of the air decreases and the trapped air deposits its moisture as water (dew) onto these surfaces. This cycle is capable of repeating thus subjecting the materials to constant rewetting. This is ideal for both mold and mildew formation on the surfaces, and this is a common occurrence behind siding and in ceiling and floor joists cavities.

The solution for this problem is to increase the rate at which air can be exchanged in these cavities so as the temperature drops, the warm moist air that was in the cavities is replaced with cooler ambient air that possesses a lower dew point that will not allow the condensation of moisture on the surrounding surfaces. This can be accomplished only where there is a clear pathway for the air to move.

Henceforth, an improved building methodology that allows for sound tight construction yet incorporates air passages for ventilation purposes would fulfill a long felt need in the building construction industry. This new invention utilizes and combines known and new technologies in a unique and novel configuration to overcome the aforementioned problems and accomplish this.

BRIEF SUMMARY

In accordance with various embodiments, a construction venting strip with or without an edge guide locating flange is provided that can be utilized between framing members.

In one aspect, a cutable construction venting strip that is sized to be used on dimensional lumber is provided. In various embodiments, the strip may or may not have an adhesive bottom face.

In another aspect, a construction venting strip is provided, capable of being cut to conform to the angles commonly used in wood frame construction.

In yet another aspect, a construction venting strip made of a high durometer polymer having both air and moisture vents and angular cut tracks is provided.

In yet another aspect, a waterproof, crushproof strip or coil that is fabricated from a self sealing butyl style polymer that can serve a triple function as a thermal break, a water barrier and a ventilation channel, and is capable of being cut with a construction razor knife along a series of repeating preformed angular channels on the top face of the is strip is provided.

Various modifications and additions can be made to the embodiments discussed without departing from the scope of the invention. For example, while the embodiments described above refer to particular features, the scope of this invention also includes embodiments having different combination of features and embodiments that do not include all of the above described features.

BRIEF DESCRIPTION OF THE DRAWINGS

A further understanding of the nature and advantages of particular embodiments may be realized by reference to the remaining portions of the specification and the drawings, in which like reference numerals are used to refer to similar components.

FIG. 1 is a top view of the first embodiment construction venting strip with support cylinders (repeating patterned cylindrical arrays);

FIG. 2 is a bottom view of the first embodiment construction venting strip;

FIG. 3 is a a side view of the first embodiment construction venting strip;

FIG. 7 is a top-view of the second embodiment strip with support pads (uniform series of pads), FIG. 8 is a bottom view of the second embodiment construction venting strip;

FIG. 9 is a side view of the second embodiment construction venting strip;

FIG. 13 is a top view of the third embodiment construction venting strip with support risers (with repeating patterned cutting channels);

FIG. 14 is a bottom view of the third embodiment construction venting strip;

FIG. 15 is a side view of the third embodiment construction venting strip.

DETAILED DESCRIPTION OF CERTAIN EMBODIMENTS

Figure 4:
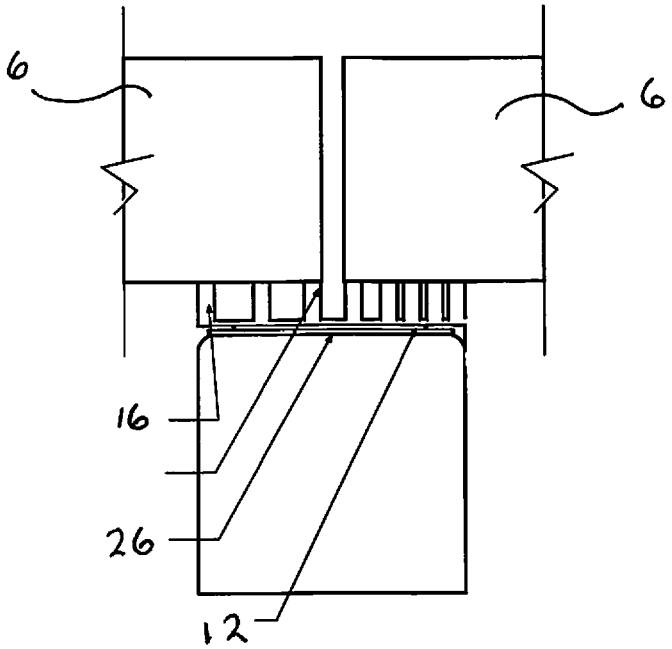
FIGS. 4-6 are end views of the of the first embodiment construction venting strip with and without mechanical fasteners.
Figure 5:
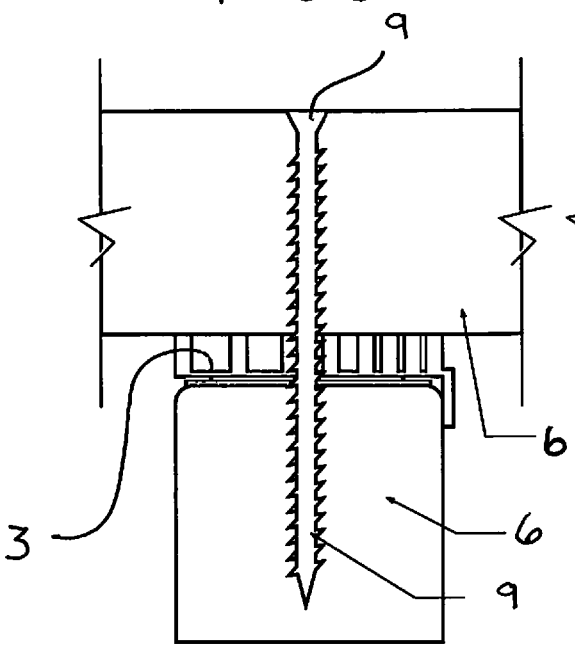

While various aspects and features of certain embodiments have been summarized above, the following detailed description illustrates at least on exemplary embodiment in further detail to enable one skilled in the art to practice such an embodiment. The described example is provided for illustrative purposes and is not intended to limit the scope of the invention.

In the following description, for the purposes of explanation, numerous specific details are set forth in order to provide a thorough understanding of the described embodiment/s. It will be apparent to one skilled in the art, however, that other embodiments of the present invention may be practiced without some of these specific details. While various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

In this description, the directional prepositions of up, upwardly, down, downwardly, front, back, top, upper, bottom, lower, left, right and other such terms refer to the device as it is oriented and appears in the drawings and are used for convenience only; they are not intended to be limiting or to imply that the device has to be used or positioned in any particular orientation.

Unless otherwise indicated, all numbers herein used to express quantities, dimensions, and so forth, should be understood as being modified in all instances by the term "about." In this application, the use of the singular includes the plural unless specifically stated otherwise, and use of the terms "and" and "or" means "and/or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

The present invention relates to a novel design for a low profile, construction venting strip 2 that is placed at an interface between framing members or materials that enclose space or form one of the walls to an adjacent enclosed void. The strip 2 provides five important functions. First, it acts as a conduit for the passage of air across it. Second, it prevents water from pooling and sitting on the surface of the underlying framing members. Third, it seals nail and screw penetrations passing through the strip and into the framing members. Fourth, it acts as a thermal break between adjacent materials. Lastly, it may be used as a furring strip or spacing strip/shim where an additional ¼ inch of framing material is needed.

Figure 6:
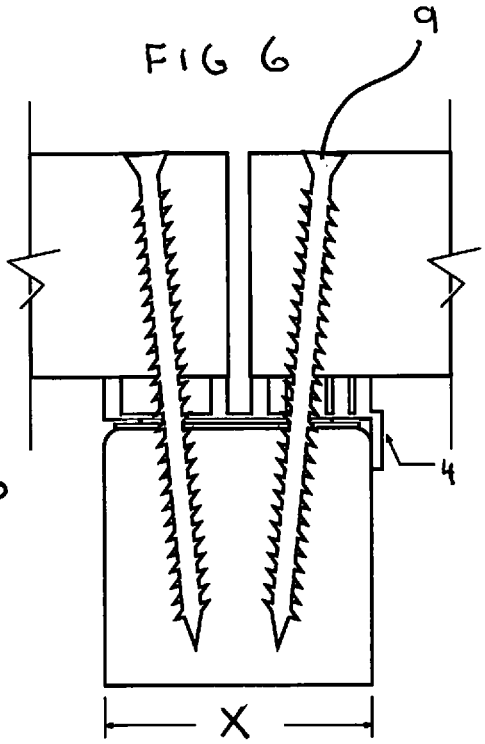
Figure 10:
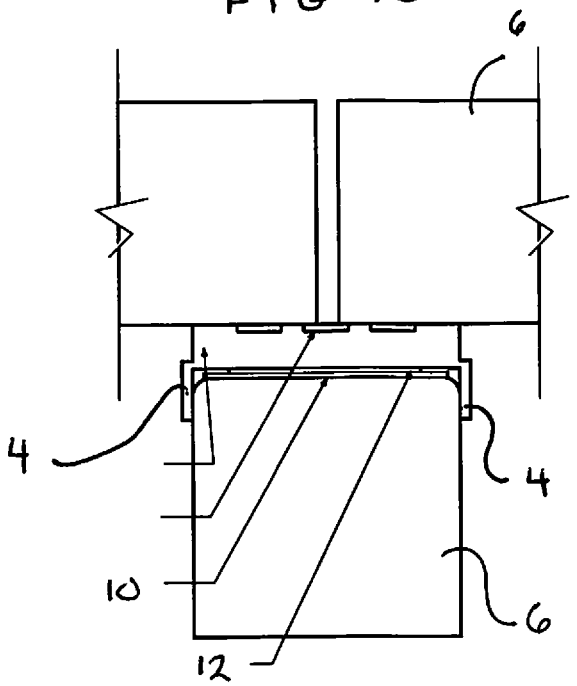
FIGS. 10-12 are end views of the second embodiment construction venting strip with and without mechanical fasteners.
Figure 11:
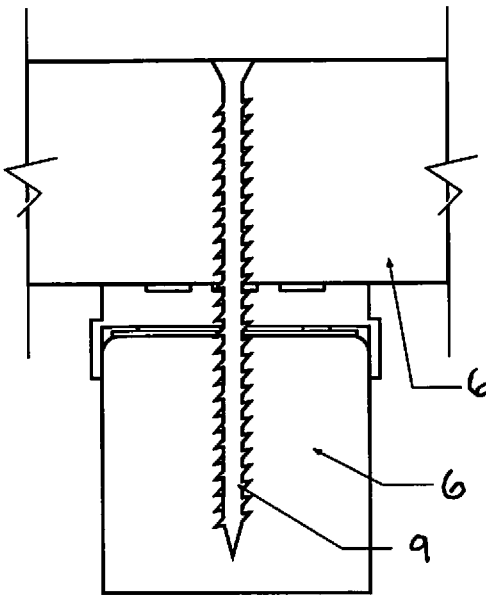
Figure 12:
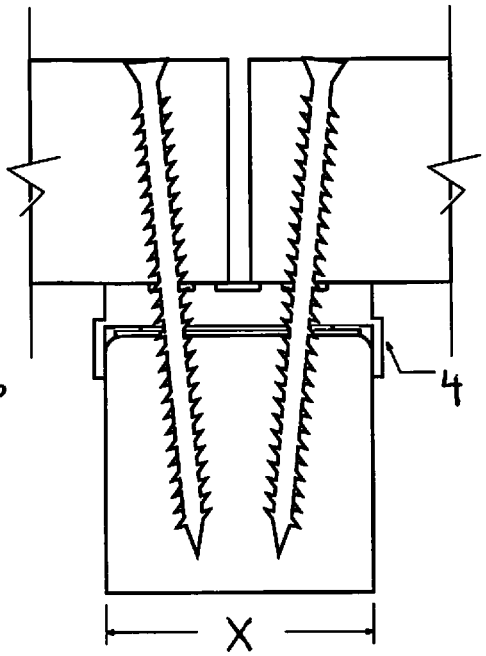
Figure 16:
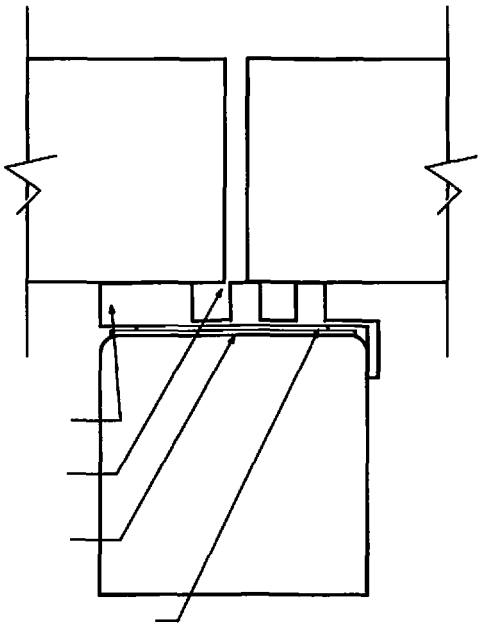
FIGS. 16-18 are end views of the third embodiment construction venting strip with and without mechanical fasteners.
Figure 17:
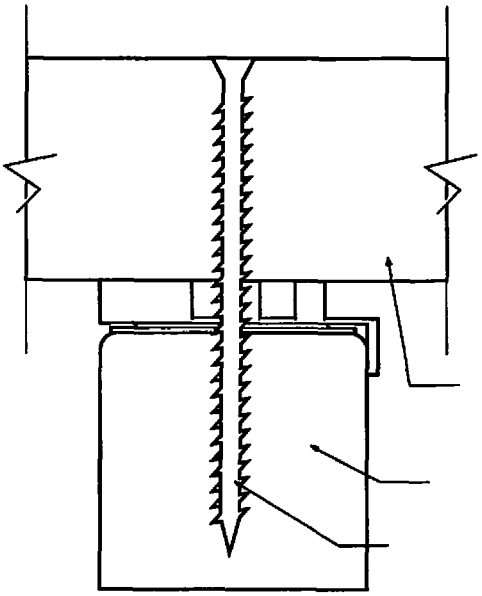
Figure 18:
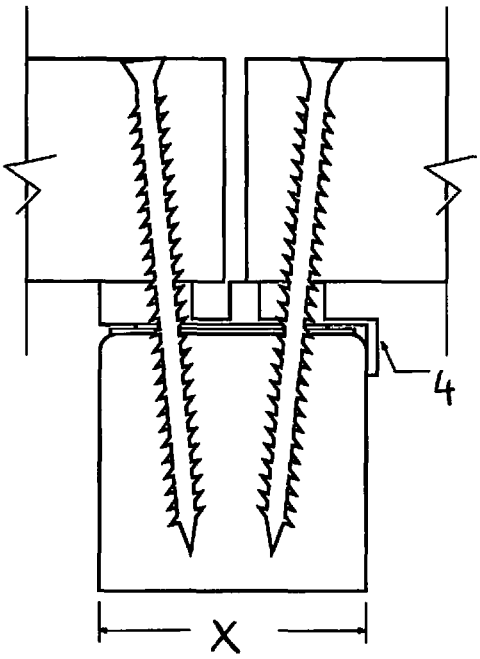

The strip 2 is a linear length of polymer that has an overall uniform width and thickness dimensioned for the construction industry (multiples of 4 feet) and for use with dimensional lumber. It is intended to be affixed with mechanical or chemical fasteners between the strip and the construction elements, which may be framing members, siding, decking, furring strips or a plethora of other common construction elements. It is a planar strip having a width and length that corresponds to those commonly utilized in the construction industry. The length preferably is approximately 48 inches and the width is identical or slightly less than that width X (FIGS. 6, 12 and 18) of standard 2 x lumber. (FIGS. 6, 12 and 18) This width is approximately 1½ inches plus or minus ⅛ inch. The strip 2 may be flangeless or have a locating flange 4 extending normally from one or both of the linear edges of the strip 2 below the bottom face 8 of the strip 2. This locating flange 4 is used to quickly align the strip's horizontal axis with the horizontal axis of a 2 x dimensional board 6 by abutment of the inside of the flange 4 to the side of the board 6 at a linear edge of the board. When in this position, the strip 2 may be fastened by screws 9. With the strip dimensioned to 1½ inches wide, it is possible to secure a single board or two boards to the underlying framing board 6, (FIGS. 5, 6, 11, 12, 17 and 18) using a single underlying strip 2. Where the strip 2 is not being affixed to dimensional lumber there would be no flange required.

The strip 2 may have a waterproof membrane 10 affixed to its bottom face 8 by an adhesive tape strip (or layer) 12 affixed to the bottom face 8 of the strip. (FIGS. 3, 4, 8, 9, 10, 15 and 16) Alternatively, the waterproof strip 10 may be affixed by a liquid adhesive applied to the bottom face of the strip by spraying. The waterproof membrane 10 may be of a self-sealing polymer to minimize water intrusion at the mechanical fastener penetrations. (Such self-sealing membranes are well known in the roofing trades.) Other configurations may utilize double sided tape so as to provide adhesion where multiple strips 2 may have to be mounted (i.e. vertically) before horizontal siding can be affixed. The adhesive strip 12 may be a double faced adhesive strip affixed to the waterproof membrane 10 or a single faced adhesive strip bonded to the waterproof membrane 10. Where the double faced adhesive strip is used without the waterproof membrane 10 there is a removable polymer film strip 26 (a peel-off liner strip) covering the second, bottom adhesive side. In this way it can be peeled away to secure the strip 2 to surfaces en masse before using a mechanical fastener. This is handy when securing strips 2 vertically and is used when the strip 2 is utilized between siding and wall sheeting. For this specific purpose there is no need for a locating flange as is seen in modified version of the first embodiment of FIG. 4 where there is no locating flange on either side of the strip 2.

The strip's primary purpose is to provide air passages across the framing interface where it is positioned. It does this by having some configuration of equal height support fins extending normally from the top face 13 (FIG. 1) of the planar strip base 3. The strip base is a linear polymer strip of a consistent width and thickness. Between these various styles of support fins there are air passages or channels 14 that allow air to migrate across the longitudinal axis of the strip 2. There are three various configurations of support fins utilized in the various embodiments. These support fin configurations may accommodate cutting of the strip 2 at different angles or just perpendicular to the linear axis of the strip 2.

Looking at FIGS. 1-6 the first embodiment strip can best be explained. This strip 2 has its support fins configured as cylindrical supports 16 arranged in a repeating, alternating pattern (patterned cylindrical arrays) across the face of the strip base 3. Between these cylindrical supports 16 is the air and moisture vent 14. Although, at first look the arrangement of the support fins appears to be random, a closer look reveals three linear cut paths on the strip base 3 across the width of the strip 2 that a knife can traverse to cut the strip 2 to a desired angle. The three cut paths are void of any support cylinders 16. The first cut path 18 is at 45 degrees to the linear axis or either longitudinal edge of the strip 2 (as the two longitudinal edges of the strip are parallel.) In a similar fashion, the second cut path 20 is at 22.5 degrees, and the third cut path 22 is at 90 degrees or perpendicular to the linear axis of the strip 2. These angles are the most common angles used in framing.

Although the support fins for this first embodiment depicted as circular cylindrical supports 16 other cylindrical geometric configurations are envisioned such as rectangular, hexagonal, octagonal, and the like.

The repeating pattern across the face of the strip is made of a shorter pattern that is mirrored about a perpendicular midpoint line 26 to the longitudinal axis of the strip lying along the midpoint of the repeating pattern. By mirroring this pattern the first and second cut lines can extend 315 degrees and 337.5 degrees from the linear axis. This allows the strip to be cut at 45 and 22.5 degrees on either side of the midpoint line 26 as the strip 2 can only be used with the bottom face 8 in contact with the underlying framing members as seen in FIGS. 3-6. In the preferred embodiment this pattern is approximately 3 inches long with the midpoint line occurring at 1½ inches from either end of the repeating pattern and incorporating 6 cut lines as follows: cut line 18 at 45 degrees, cut line 20 at 22.5 degrees, cut line 22 at 0 degrees, cut line 23 at 0 degrees, cut line 25 at 315 degrees and cut line 27 at 337.5 degrees radially from the center of the midpoint line 26, which is the center of the repeating pattern.

The advantage of this surface configuration is that it offers more air passage. The amount of surface on the strip covered by support fins is greater than 30% and optimally approximately 30-40% leaving approximately 60-70% of the strip's surface area as an air and moisture vent 14. While offering more air passage there is less lateral support to each of the support fins, and although made of the same durometer of the other strips 2—this first embodiment is prone to crushing and a reduction in its thickness when under high point loads because of the sideways deformation (bending) of the individual support fins.

Looking at FIGS. 7-12 the second embodiment strip can best be explained. This strip 2 has its support fins configured as support pads 28 (uniform series of equally spaced rectangular raised pads) extending upward from the top face of the strip base 3. Here the pads are all identical in configuration, aligned in three linear rows, and the air and moisture vent 14 resides between all sides of adjacent support pads 28. Since the pads are aligned there are cut troughs across the width of the base strip 3 before and after each pad. This embodiment has locating flanges 4 on either side of the strip 2. This dual flange design necessitates that the width of the strip 2 between the inside faces of the two locating flanges 4 is a minimum of 1½ inches so the strip 2 will lay flat on a standard 2 x dimensional joist. Here, the surface area of the support fins (support pads 28) is at least 40% of the surface area of the strip base 3 with the optimal range of 40 to 50%.

Looking at FIGS. 13-18 the third embodiment strip can best be seen. This strip has its support fins configured as support risers 30 (repeated patterned linear raised strips residing at an angle to the linear axis of the strip) arranged in a repeating, alternating pattern across the face of the strip base 3. Between these support risers 30 is the air and moisture vent 14. Although, at first look the arrangement of the support fins appears to be random, a closer look reveals three linear cut paths on the strip base 3 across the width of the strip 2 that a knife can traverse to cut the strip 2 to a desired angle. This is similar to those in the first embodiment. The three cut paths are clear channels between the support risers 30. The first cut path 32 is at 45 degrees to the linear axis or either longitudinal edge of the strip 2 (as the two longitudinal edges of the strip are parallel.) In a similar fashion, the second cut path 34 is at 22.5 degrees, and the third cut path 36 is at 90 degrees or perpendicular to the linear axis of the strip 2. This embodiment also utilizes a repeating, pattern across the face of the strip made of two identical patterns that are mirrored about a perpendicular midpoint line 40 to the longitudinal axis of the strip lying along the midpoint of the repeating pattern. By mirroring this pattern the first and second cut lines can extend 315 degrees and 337.5 degrees radially from the midpoint of the repeating pattern as in the first embodiment. This allows the strip to be cut at 45 and 22.5 degrees on either side of the midpoint line 40. Here the surface area of the support fins (support risers 30) is at least 50% of the area of the strip base 3.

In use, the strip 2 is placed atop an edge surface of a 2x dimensional board 6. If it has a locating flange 4 the strip 2 is positioned such that the inside face of the flange 4 contacts the outside face of the board 6 while the bottom face of the strip 2 contacts the edge face of the board. The strip 2 may be tacked down to hold it in place before the top board is placed atop the strip 2 and the mechanical fastener secured between all three elements. If the strip 2 has two locating flanges the process is the same. If the strip 2 has no flanges but instead an adhesive strip, the peel strip of film is removed form the strip 2 and the strip 2 is centered along the area of intended placement. Securement by mechanical fasteners may occur now or later upon placement of the top construction material.

In the preferred embodiment, the strip 2 will be made of a polymer having excellent compression and deflection resistance. It will also have a high dielectric strength and as such will not utilize any type of conducting fillers. UV protection is not necessary because of their placement between framing members however it may be utilized in specific conditions such as on decking with spaced top boards. It will have a hardness between 50 and 100 on the Shore A Durometer scale, preferably between 60 and 80. This will be in the range of a tire tread or of a shoe heel. If the material is too hard, nails will bend before piercing through the strip 2 or the strip will shatter/split/chip when struck with a hammer or a framing member is dropped onto it. Especially if used during cold weather. If it is not hard enough it will tear or compress under load closing up the ventilation channels. In the preferred embodiment the waterproof strip 10 will be made of butyl rubber mixed with bitumen to enable both the waterproof and self-sealing characteristics.

In the preferred embodiment the overall thickness of the strip 2 is approximately ¼ inch and the thickness of the strip base is 3⁄32 of an inch. The remainder of the strip's thickness is the support fins. With a durometer in the range of 60to 80 on the Shore A Durometer scale and anticipated load pressures of 40 psi (as per the U.S. Residential Building code) there will be negligent to minimal compression. However, with anticipated maximum point loads reaching 300-500 psi the. strip 2 with the support dot risers (patterned dot arrays) may compress to a thickness no less than 95% of its original thickness. 3⁄32 of an inch. This amount of compression is greater than the other two surface configurations not because of a lower durometer but because the ample space around each dot allows for the sideways deflection (bending) of each dot. Strips with support channel risers (repeated patterned cutting channels), and support pad risers (uniform series of pads) in the durometer range specified, do not compress substantially and can be considered incompressible.

While certain features and aspects have been described with respect to exemplary embodiments, one skilled in the art will recognize that numerous modifications are possible. For example, the embodiments shown reflect any of the following features which can be used alone or in combination with the other features: adhesive tape, self sealing tape, a single edge flange, a dual edge flange, four foot strips, coils, support risers, support pads (uniform series of pads), support cylinders (patterned cylindrical arrays).

Hence, while various embodiments are described with—or without—certain features for ease of description and to illustrate exemplary aspects of those embodiments, the various components and/or features described herein with respect to a particular embodiment can be substituted, added, and/or subtracted from among other described embodiments, unless the context dictates otherwise. Consequently, although several exemplary embodiments are described above, it will be appreciated that the invention is intended to cover all modifications and equivalents within the scope of the following claims.

Having thus described the invention, what is claimed as new and desired to be secured by Letters Patent is as follows:

1. A construction venting strip, comprising:

a linear, planar, base strip made of a polymer, said base strip having a width, a length, a linear axis, two parallel linear edges, a planar top face and a planar bottom face, said top face having an area;

a series of equal height support fins extending from said top face;

a venting space defined there between said support fins extending across said width of said strip;

wherein said planar base strip and said support fins are made of a polymer having a hardness in the Shore A Durometer scale range of 60-80, and wherein said support fins are arranged in a repeating pattern that incorporates six cut lines across the width of said construction venting strip.

2. The construction venting strip of claim 1 further comprising:

a two faced adhesive strip having an upper side and a lower side, said upper side affixed to said bottom face of said base strip.

3. The construction venting strip of claim 2 further comprising:

a waterproof, polymer strip affixed to said lower side of said two faced adhesive strip.

4. The construction venting strip of claim 2 further comprising:

a self-sealing waterproof, polymer strip affixed to said lower side of said two faced adhesive strip.

5. The construction venting strip of claim 3 further comprising:

at least one locating edge extending normally from said planar bottom face along one of said two parallel edges.

6. The construction venting strip of claim 5 wherein said series of support fins extending from said top face are cylindrical supports.

7. A construction venting strip, comprising:

a linear, planar, base strip made of a polymer, said base strip having a width, a length, a linear axis, two parallel linear edges, a planar top face and a planar bottom face, said top face having an area;

a series of equal height cylindrical support fins extending from said top face;

a venting space defined there between said support fins extending across said width of said strip;

a two faced adhesive strip having an upper side and a lower side, said upper side affixed to said bottom face of said base strip;

a waterproof, polymer strip affixed to said lower side of said two faced adhesive strip;

at least one locating edge extending normally from said planar bottom face along one of said two parallel edges; and wherein said planar base strip and said support fins are made of a polymer having a hardness in the Shore A Durometer scale range of 60-80;

wherein said cylindrical supports are arranged in a repeating pattern that incorporates six cut lines across the width of said construction venting strip, said cut lines residing sequentially at 45 degrees, 22.5 degrees, 0 degrees, 0 degrees, 337.5 degrees and 315 degrees radially from a midpoint of said repeating pattern.

8. The construction venting strip of claim 7 wherein said repeating pattern is made of two adjacent identical patterns, each with three cut lines, said identical patterns positioned in a mirror image configuration about a line perpendicular to said linear axis and positioned at the midpoint of said repeating pattern.

9. The construction venting strip of claim 6 wherein said cylindrical supports occupy at least 30% of a surface area of said planar top face.

10. The construction venting strip of claim 1 wherein said cut lines reside sequentially at 45 degrees, 22.5 degrees, 0 degrees, 0 degrees, 337.5 degrees and 315 degrees radially from a midpoint of said repeating pattern.

* * * * *